US005600418A

United States Patent [19]

Hart et al.

[11] Patent Number: 5,600,418

[45] Date of Patent: Feb. 4, 1997

[54] DONOR ROLLS WITH EXTERIOR COMMUTATION

[75] Inventors: Steven C. Hart, Webster; Mark S. Amico; Glenn M. Keenan, both of Rochester, all of N.Y.

[73] Assignee: Xerox Corporation, Stamford, Conn.

[21] Appl. No.: 533,108

[22] Filed: Sep. 25, 1995

[51] Int. Cl.[6] ..... G03G 15/06

[52] U.S. Cl. ..... 399/285; 310/231; 310/236

[58] Field of Search ..... 355/259, 261, 355/265; 118/648; 310/233, 232, 236, 231

[56] References Cited

U.S. PATENT DOCUMENTS

| | | | |
|---|---|---|---|
| 3,257,224 | 6/1966 | Jons et al. | 117/17.5 |
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,172,170 | 12/1992 | Hays et al. | 355/259 |
| 5,268,259 | 12/1993 | Sypula | 430/311 |
| 5,289,240 | 2/1994 | Wayman | 355/259 |
| 5,394,225 | 2/1995 | Prker | 355/259 |
| 5,515,142 | 5/1996 | Rommelmann | 355/259 |
| 5,517,287 | 5/1996 | Rodriguez et al. | 355/259 |

*Primary Examiner*—Nestor R. Ramirez
*Attorney, Agent, or Firm*—John S. Wagley

[57] ABSTRACT

A donor roll for transporting marking particles to an electrostatic latent image recorded on a surface is provided. The donor roll is adaptable for use with a power source to assist in transporting the marking particles. The donor roll includes a rotatably mounted body having a particle transportation portion, a support portion adjacent the particle transportation portion, and an external portion adjacent the support portion and spaced from the particle transportation portion. The donor roll further includes an electrode member mounted on the body and an electrical connector associated with the support portion of the body and electrically connected to the electrode member. The electrical connector is adapted to be electrically connectable to the power source.

26 Claims, 7 Drawing Sheets

DONOR ROLLS WITH EXTERIOR COMMUTATION

The present invention relates to a developer apparatus for electrophotographic printing. More specifically, the invention relates to a donor roll as part of a scavengeless development process.

Cross reference is made to the following applications filed concurrently herewith: U.S. application Ser. No. 08/533,627, filed Sep. 25, 1995, entitled "Donor Rolls with Magnetically Coupled (Transformer) Commutation", by Steven C. Hart et al. and U.S. application Ser. No. 08/533,226, filed Sep. 25, 1995, entitled "Donor Rolls with Modular Commutation", by Steven C. Hart.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al. U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. The conductive brush is electrically connected with a electrically biasing source. The brush is typically a conductive fiber brush made of protruded fibers or a solid graphite brush. Typically only a few electrodes in the nip between the donor member and the developing surface are electrically biased. As the donor member rotates, the electrodes that now are in the nip need to contact the brush. Typically only these electrodes in the nip between the donor member and the developing surface are electrically biased. Since the distance between the nip and the developing surface is very small it is impractical to position the conductive brush in the nip. To accomplish the biasing of the donor member, the member must be extended beyond the developing surface. The donor member is typically an expensive complicated component that is very long and slender. U.S. Pat. No. 5,172,170 is herein incorporated by reference.

Donor members are long to accommodate sufficiently wide copy substrates and slender to minimize developer housing size. Donor members require extremely accurate dimensions to meet copy quality requirements. Commutation exasperates this problem. The critical dimensions of a donor roll include the outside diameter, surface finish and runout of the donor member periphery. The added length of the donor member required to accommodate the commutation of the donor roll electrodes makes the maintaining of these critical dimensions even more difficult.

Donor members are typically supported by bearings on each end of the member. The added length of the donor member required to accommodate the commutation makes the distance between the bearing greater. The greater distance between bearing caused by the commutating need makes the maintaining of the runout requirement more difficult.

The following disclosures related to scavangeless and electroded rolls may be relevant to various aspects of the present invention:

U.S. Patent application Ser. No. 08/376,585

Applicant: Rommelmann et al.

Filing Date: Jan. 23, 1995

U.S. Patent application Ser. No. 08/339,614

Applicant: Rommelmann

Filing Date: Nov. 15, 1994

U.S. Pat. No. 5,394,225

Patentee: Parker (Prker)

Issue Date: Feb. 28, 1995

U.S. Pat. No. 5,289,240

Patentee: Wayman

Issue Date: Feb. 22, 1994

U.S. Pat. No. 5,268,259

Patentee: Sypula

Issue Date: Dec. 7, 1993

U.S. Pat. No. 5,172,170

Patentee: Hays et al.

Issue Date: Dec. 15, 1992

U.S. Pat. No. 4,868,600

Patentee: Hays et al.

Issue Date: Sep. 19, 1989

U.S. Pat. No. 3,996,892

Patentee: Parker et al.

Issue Date: Dec. 14, 1976

U.S. Pat. No. 3,980,541

Patentee: Aine

Issue Date: Sep. 14, 1976

U.S. Pat. No. 3,257,224

Patentee: Jons et al.

Issue Date: Jun. 21, 1966

Ser. No. 08/376,585 discloses an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

Ser. No. 08/339,614 discloses a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

U.S. Pat. No. 5,394,225 discloses a donor roll which has two sets of interdigitized embedded electrodes in the surface. An optical switching arrangement is located between a slip ring commutated by a brush and one set of interdigitated electrodes. The optical switching arrangement includes a photoconductive strip.

U.S. Pat. No. 5,289,240 discloses a donor roll which has two distinct sets of electrodes along the periphery of the donor roll. The roll has a first set of electrodes that extend axially the length of the roll. The first set of electrodes includes groups of 1 to 6 electrodes which are electrically interconnected to each other and are commutated by contacting the filaments of a brush which is electrically interconnected to a biasing source. The roll also has a second set of electrodes that extend axially the length of the roll, are interconnected to each other, do not contact the brush, and are grounded.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenloic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

U.S. Pat. No. 3,257,224 discloses a developing apparatus including a trough to contain magnetizable developer and a magnetic roller. The roller transports the developer to an electrophotographic material and includes plates having a number of windings. The plates and windings are located inside the roll. The plates and windings serve as electromagnets to magnetically attract the developer so that it may be transported to the material.

SUMMARY OF THE INVENTION

According to the present invention there is provided a donor roll for transporting marking particles to an electrostatic latent image recorded on a surface. The donor roll is adaptable for use with a power source to assist in transporting the marking particles. The donor roll includes a rotatably mounted body having a particle transportation portion, a support portion adjacent the particle transportation portion, and an external portion adjacent the support portion and spaced from the particle transportation portion. The donor roll further includes an electrode member mounted on the body and an electrical connector associated with the external portion of the body and electrically connected to the electrode member. The electrical connector is adapted to be electrically connectable to the power source.

According to the present invention, there is also provided a developer unit for developing a latent image recorded on on a surface of an image receiving member to form a developed image. The developer unit is adaptable for use with a power source to assist in transporting the marking particles from the developer unit to the image receiving member. The developer unit includes a housing defining a chamber for storing at least a supply of marking particles therein and a bearing mounted to the housing. The developer unit also includes a movably mounted donor member spaced from the surface and adapted to transport marking particles from the chamber of the housing to a development zone adjacent the surface. The donor member has a rotatably mounted body having a particle transportation portion, a support portion adjacent the particle transportation portion, and an external portion adjacent the support portion and spaced from the particle transportation portion, an electrode member mounted on the body, and an electrical connector associated with the external portion of the body and electrically connected to the electrode member. The support portion of the donor member is mounted to the bearing. The developer unit also includes a commutator electrically connected to the electrical connector and adapted to be electrically connectable to the power source.

According to the present invention, there is further provided an electrophotographic printing machine of the type having a developer unit adapted to develop with marking particles an electrostatic latent image recorded on an image receiving member. The developer unit is adaptable for use with a power source to assist in transporting the marking particles from the developer unit to the image receiving member. The improvement includes a housing defining a chamber for storing at least a supply of marking particles therein and a bearing mounted to the housing. The developer unit also includes a movably mounted donor member spaced from the surface and adapted to transport marking particles from the chamber of the housing to a development zone adjacent the surface. The donor member has a rotatably mounted body having a particle transportation portion, a support portion adjacent the particle transportation portion, and an external portion adjacent the support portion and spaced from the particle transportation portion, an electrode member mounted on the body, and an electrical connector associated with the external portion of the body and electrically connected to the electrode member. The support portion of the donor member is mounted to the bearing. The developer unit also includes a commutator electrically connected to the electrical connector and adapted to be electrically connectable to the power source.

IN THE DRAWINGS:

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
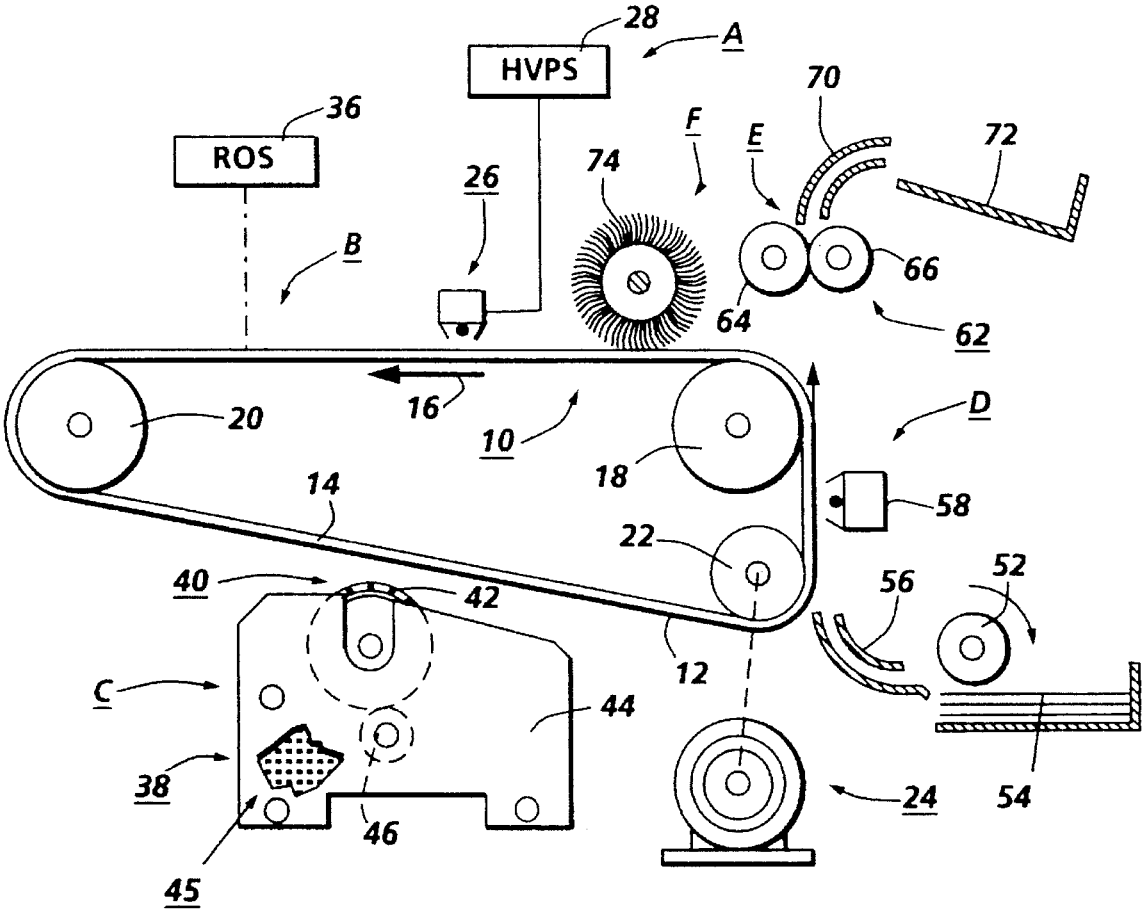
FIG. 2 is a schematic elevational view of printing machine incorporating the external commutation segmented donor roll of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. Preferably, development system 38 includes a donor roll or roller 40 and electrical conductors in the form of embedded electrode wires or electrodes 42 embedded on the periphery of the donor roll 40. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
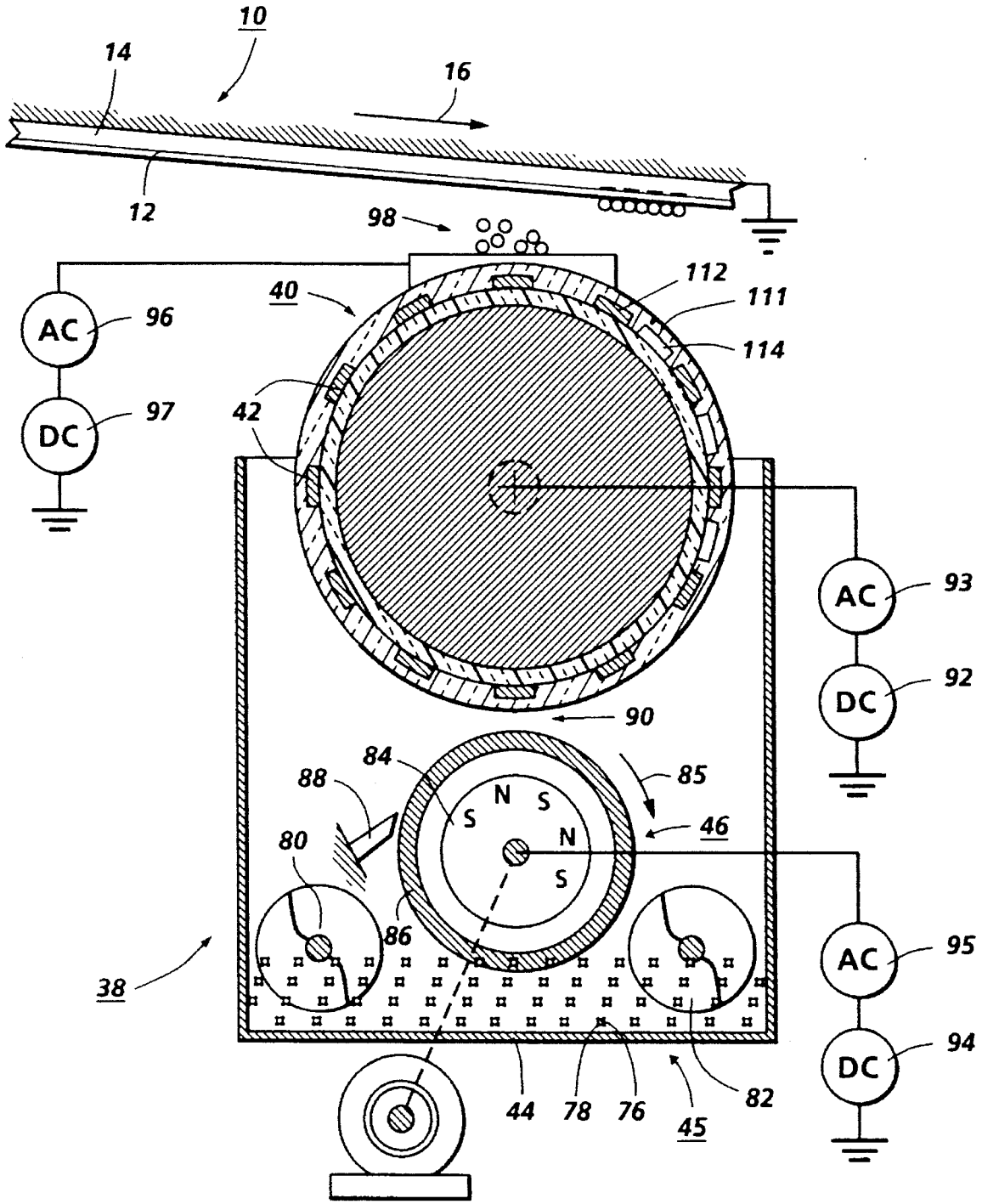
FIG. 3 is a schematic elevational view of development unit incorporating the external commutation segmented donor roll of FIG. 1.

Referring now to FIG. 3, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material designed to be rotated about the magnet 84 in a direction indicated by arrow 85. The toner particles 78 are attached triboelectrically to the magnetic carrier granules 76 to form the developer material 45. The magnetic field of the stationary multi-pole magnet 84 draws the magnetic carrier granules 76, toward the roll and along with the granules 76, the toner particles 78. The developer material 45 then impinges on the exterior of the sleeve 86. As the sleeve 86 turns, the magnetic fields provide a frictional force to cause the developer material 45 including the carrier granules 76 to rotate with the rotating sleeve 86. This in turn enables a doctor blade 88 to meter the quantity of developer adhering to sleeve 86 as it rotates to a loading zone 90, the nip between transport roll 46 and donor roll 40. This developer material adhering to the sleeve 86 is commonly referred to as a magnetic brush.

The donor roll 40 includes the electrodes 42 in the form of electrical conductors positioned about the peripheral circumferential surface thereof. The electrodes are preferably positioned near the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Half of the electrodes, every other one, are electrically connected together. Collectively these electrodes are referred to as common electrodes 114. The remaining electrodes are referred to as active electrodes 112, These may be single electrodes or they may be electrically connected together into small groups. Each group is typically on the order of 1 to 4 electrodes; all groups within the donor roll having the same number of electrodes.

Either the whole of the donor roll 40, or at least a layer 111 thereof, is preferably of a material which has sufficiently low electrical conductivity. This material must be sufficiently conductive so as to prevent any long term build up of electrical charge. Yet, the conductivity of this layer must be sufficiently low so as to form a blocking layer to prevent shorting or arcing of the magnet brush to the donor roll electrode members and/or donor roll core itself.

Embedded within the low conductivity layer 111 are the donor roll electrodes 42. As earlier stated these electrodes may be classified as common electrodes 114 or as active electrodes 112. The common electrodes 114 are all electrically connected together. The active electrodes 112 may be electrically connected into small groups of 1 to 4 electrodes.

The donor roll 40 and common electrodes 114 are kept at a specific voltage with respect to ground by a direct current (DC) voltage source 92. An alternating current (AC) voltage source 93 may also be connected to the donor roll 40 and the commons.

The transport roll 46 is also kept at a specific voltage with respect to ground by a DC voltage source 94. An AC voltage source 95 may also be connected to the transport roll 46.

By controlling the magnitudes of the DC voltage sources 92 and 94 one can control the DC electrical field created across the magnetic brush, i.e. between the donor roll surface and the surface of the rotating sleeve 86. When the electric field between these members is of the correct polarity and of sufficient magnitude, it will cause toner particles 78 to develop from the magnetic brush and form a layer of toner particles on the surface of the donor roll 40. This development will occur in what is denoted as the loading zone 90.

By controlling the magnitude and frequencies and phases of the AC voltage sources 93 and 95 one can control the magnitude and frequency of the AC electrical field created across the magnetic brush, i.e. between the donor roll surface and the surface of the rotating sleeve 86 of magnetic roll 46. The application of the AC electrical field across the magnetic brush is known to enhance the rate at which the toner layer develops onto the surface of the donor roll 40.

It is believed that the effect of the AC electrical field applied across the magnetic brush in the loading zone between the surface of the donor roll 40 and the rotating sleeve 86 is to loosen the adhesive and triboelectric bonds of the toner particles to the carrier beads. This in turn makes it easier for the DC electrical field to cause the migration of the toner particles from the magnetic brush to donor roll surface.

In the loading zone, it is also desirable to connect the active electrodes 112 to the same DC voltage source as the one to which the common electrodes 114 are connected. In this case the connection in the loading zone would be to DC voltage source 92. This has been demonstrated to improve the efficiency with which the donor roll is loaded. Additionally, it has been demonstrated that the application of AC electrical voltage to the active electrodes 112 can enhance the development efficiency.

While the development system 38 as shown in FIG. 3 utilizes donor roller DC voltage source 92 and AC voltage source 93 as well as transport roller DC voltage source 94 and AC voltage source 95, the invention may be practiced, with merely DC voltage source 92 on the donor roller.

It has been found that a value of about 200 V rms applied across the magnetic brush between the surface of the donor roll 40 and the sleeve 86 is sufficient to maximize the loading/reloading/development efficiency. That is the delivery rate of toner particles to the donor roll surface is maximized. The actual value can be adjusted empirically. In theory, the values can be any value up to the point at which arcing occurs within the magnetic brush. For typical developer materials and donor roll to transport roll spacings and material packing fractions, this maximum value is on the order of 400 V rms.The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

Donor roll 40 rotates in the direction of arrow 91. The relative voltages between the donor roll 40, common electrodes 114, and active electrodes 112, and the sleeve 86 of magnetic roll 46 are selected to provide efficient loading of toner from the magnetic brush onto the surface of the donor roll 40. Furthermore, reloading of developer material on magnetic roll 46 is also enhanced. In the development zone, AC and DC electrode voltage sources 96 and 97, respectively, electrically bias electrical conductors 42 to a DC voltage having an AC voltage superimposed thereon. Electrode voltage sources 96 and 97 are electrically connectable with isolated electrodes 42. As donor roll 40 rotates in the direction of arrow 91, successive electrodes 42 advance into development nip 98, the nip between the donor roll 40 and the photoreceptor belt 10, and are electrically biased by voltage sources 96 and 97.

The construction and geometry of a segmented donor roll is described in detail in U.S. Pat. No. 5,172,259 to Hays et al., U.S. Pat. No. 5,289,240 to Wayman, and U.S. Pat. No. 5,413,807 to Duggan the relative portions thereof incorporated by reference herein.

Figure 1:
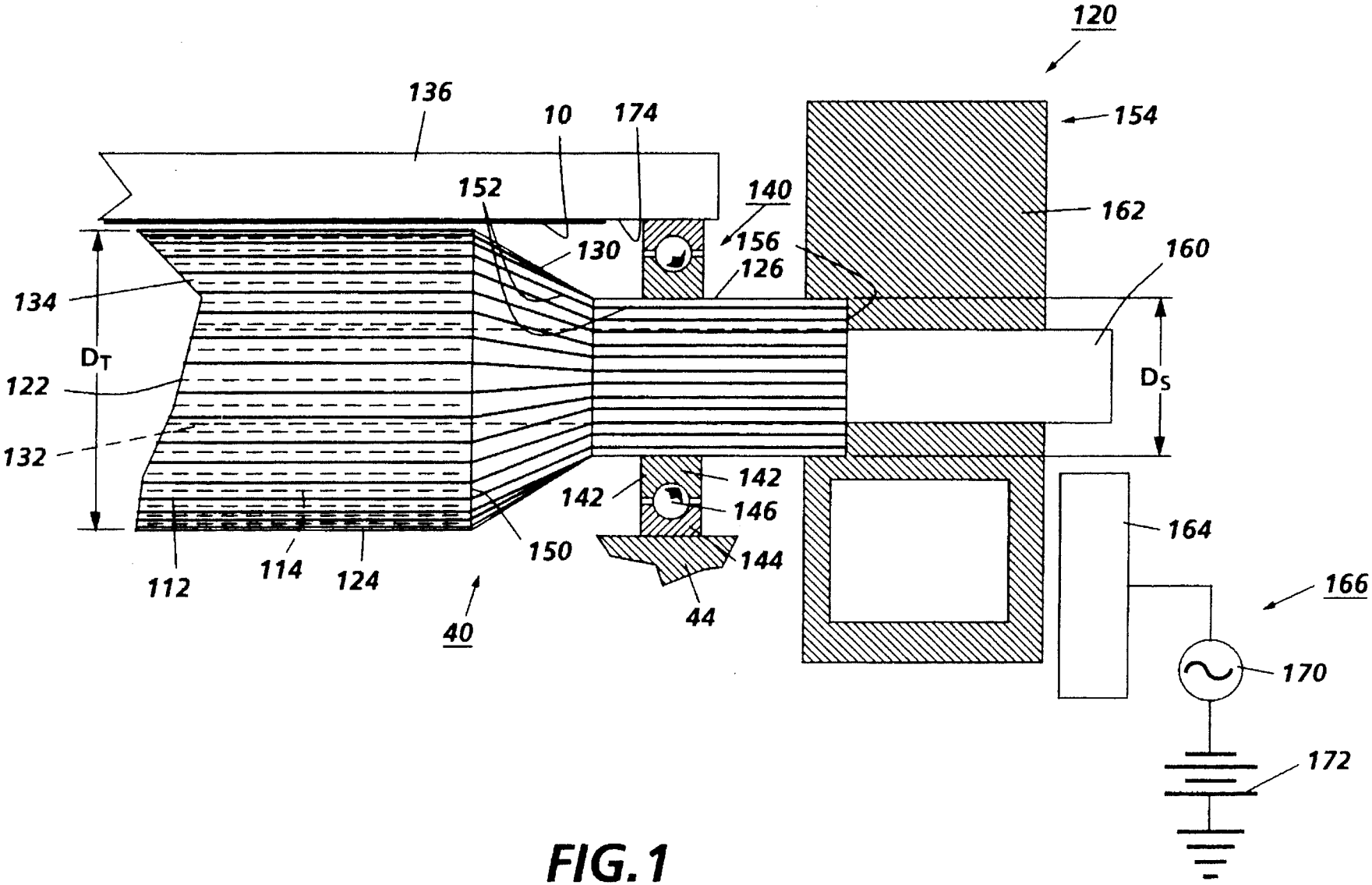
FIG. 1 is a schematic elevational view of a first embodiment of an external commutation segmented donor roll of the present invention.

According to the present invention and referring to FIG. 1, an external commutation system 120 is shown. The external commutation system 120 includes the donor member 40. The donor member 40 may be in any suitable form, for example, in the form of a endless belt or a generally cylindrically shaped roll. As shown in FIG. 1, the donor member 40 is in the form of a donor roll. The donor roll 40 includes a rotatably mounted body 122. The rotatably mounted body 122 includes a particle transportation portion 124 as well as a support portion 126. The particle transportation portion 124 of the donor roll 40 receives the toner particles from the transport roll (see FIG. 3). The particle transportation portion 124 includes the active electrodes 112 which assist in removing the toner particles from the roll 40 to form the powder cloud. The particle transportation portion 124 is thus adjacent the photoconductive belt 10 so that the powder cloud may develop the latent image on the belt 10. The support portion is that portion of the roll 40 that supports the roll 40. The particle transportation portion 124 and the support portion 126 may have the same diameter or as shown in FIG. 1, the support portion 126 may have a smaller diameter than the particle transportation portion 124. When the support portion 126 and the particle transportation portion 124 have different diameters, for example the support portion being smaller to minimize the size of the donor roll 40, a neck down region 130 is located between the particle transportation portion 124 and the support portion portion 126 of the body 122 of the roll 40.

Typically, the body 122 includes a core 132 over which an overlayed material 134 is placed. The overlayed material 134 may be applied in any suitable manner, for example the material 134 may be a molded material, molded onto the core 132. The core 132 may be electrically conductive or non-conductive and may, for example, be made of a durable high strength, electrically conductive material, for example, aluminum. The molded material 134 may be made from any suitable durable material and is explained more fully in earlier mentioned patents which have been incorporated by reference.

Active electrode members 112 are preferably equally spaced and axially positioned along the periphery of the body 122 and are applied over the molded material 134. Equally spaced and located between the active electrode members 112 are the common electrode members 114. If the core 132 is made of a conductive material, the common electrode members 114 may be electrically connected to the core 132 to provide a grounding path for the common electrodes.

Positioned close to the particle transportation portion 124 of the body 122 of the roll 40 is a backer bar 136. The backer bar 136 serves to position the photoreceptor 10 in a precise location adjacent to the particle transportation portion 124 of the body 122 of the roll 40. The photoreceptor 10 is guided about periphery 174 of the backer bar 136. While the relative size of the diameters of the support portion 126 and the particle transportation portion 124 may be varied to optimize the operation of the external commutation system 120, it may be desirable to select the diameter of the support portion $D_S$ and the diameter of the particle transportation portion $D_T$ such that the backer bar 136 may be chosen with a uniform diameter.

The backer bar 136 may be made from any suitable durable material, for example, a metal such as steel, and serves to support photoreceptor 10 and to position photoreceptor 10 in a position spaced from it near the donor roll 40. The support portion 126 of the roll 40 is secured to housing 44 by bearing 140. Typically, inner race 142 of the bearing 140 is fitted over the support portion 126. To provide the necessary strength and accuracy, typically the bearing 140 is a rolling element bearing, for example, a ball type bearing. It should be appreciated, however, that the invention may be practiced where the bearing 140 is a sleeve bearing or other type of bearing. Outer race 144 of the bearing 140 is mounted into housing 44. Bearing balls 146 separate inner race 142 from the outer race 144. The fit between the inner race 142 and the support portion 126 as well as the fit between the outer race 144 and the housing 44 may be selected for optimum performance and the races may be secured respectively to the housing 44 and the support portion 126 by any suitable means such as slip fit, press fit, glue or any other suitable means.

The active electrode members 112, as well as the common electrode members 114 may be positioned in any suitable manner over the molded material 134. For example, the active electrode members 112 and 114 respectively, may be placed in grooves along the molded material 134 or as shown in FIG. 1, be overcoated or positioned over the molded material 134.

At a first end 150 of the particle transportation portion 124 of the body 122 of the roll 40, the active electrode members 112 are electrically connected to electrical conductors 152. The electrical conductors 152 can take any suitable form and may be positioned along the periphery of the neck down region 130 and the support portion 126 or may be positioned internal to the neck down region 130 and the support portion 126. The electrical conductors 152 may be made of any suitable durable material which is electrically conductive, for example, copper. The electrical conductors 152 may be positioned in grooves along the periphery of the neck down region 130 and the support portion 126 or, as shown in FIG. 1, may be positioned upon the periphery of the neck down region 130 and the support portion 126. As shown in FIG. 1, the electrical conductors 152 may be made of a similar material and applied at the same time as the active electrode members 112. The electrical connectors 152 may be applied in any configuration along the periphery of the support portion 126 in the neck down region 130, but for simplicity, the electrical conductors 152 are positioned in parallel lines, axially along the body 122.

The electrical connectors 152 extend from the first end 150 of the particle transportation portion 124 to a commutator 154. A connector 156 is used to electrically connect the electrical conductor 152 to the commutator 154. The electrical conductor 152 may be permanently attached by the connector 156 to the commutator 154. The electrical conductor 152 may make a direct and permanent electrical contact with the connector 156. Preferably, however, the connector 156 is made of a connector such as a pin and socket type of connector 156 which permits the removable connection of the commutator 154 to the electrical conductor 152. The electrical conductor 152 may be removably connected to the connector 156 by any suitable form or shape, for example, a socket assembly could be permanently mounted onto the support portion 126 of the donor roll 40 and electrical contacts to the electrical conductors 152 of the roll 40 may be made by wire bonding or other technique and the socket assembly be interconnected with the commutator 154 through the connector 156. Alternatively, the commutator 154 may be permanently secured to the rotatably mounted body 122 and contact may be made between the electrical conductors 152 and the connectors 156 via wire bonding or spring loaded socket technology. While a commutator separate from the donor roll 40 is preferred, it should be appreciated that it may be possible to directly commutate the electrical conductors 152 by means of a brush directly applied onto the electrical conductors 152.

To avoid shorts, arcing or to minimize capacitive cross linking between the active electrode members 112, an insulative overcoat (not shown) should be applied to the periphery of both the neck down region 130 and the support portion 126 of the body 122 of the donor member 40.

To further minimize the capacitive cross coupling between the active electrodes, the bearing 140 should include an element which is non-conductive. For example, the inner race 142 or the balls 146 may be made of a non-conductive material, for example, a ceramic. Commercial bearings are available with ceramic inner races or ceramic balls.

The commutator 154 may use any applicable commutating technology. For example, the commutator 154 may include a rotating portion 160 which is mechanically linked with the donor roll 40 and a fixed (stator) portion 162 which is electrically connected to power source 166. The power source 166 may include an a.c. portion 170, as well as a d.c. portion 172. The rotating portion 160 and the fixed portion 162 may, for example, be in intimate contact with a brush (not shown) providing the contact therebetween. Photoconductive, capacitive, resistive, or other technology couplings may be likewise utilized in the commutator 154. For example, a brush type commutator may be removed from the external commutating system 120 and replaced by a commutator (not shown) having a non-contact commutation.

The bearing 140 serves to position the backer bar 136 with a periphery 174 of the backer bar 136 contacting the outer race 144 of bearing 140 and in close proximity to the periphery of the particle transportation portion 124 of the body 122 of the roll 40. By utilizing a roll 40 with a body 122 as shown in FIG. 1 having a neck down region 130, a diameter $D_S$ of the support portion 126 may be chosen appropriately smaller than diameter $D_T$ of the particle transportation portion such that the backer bar 136 may be constructed with a straight or uniform periphery 174, as shown in FIG. 1.

Figure 4A:
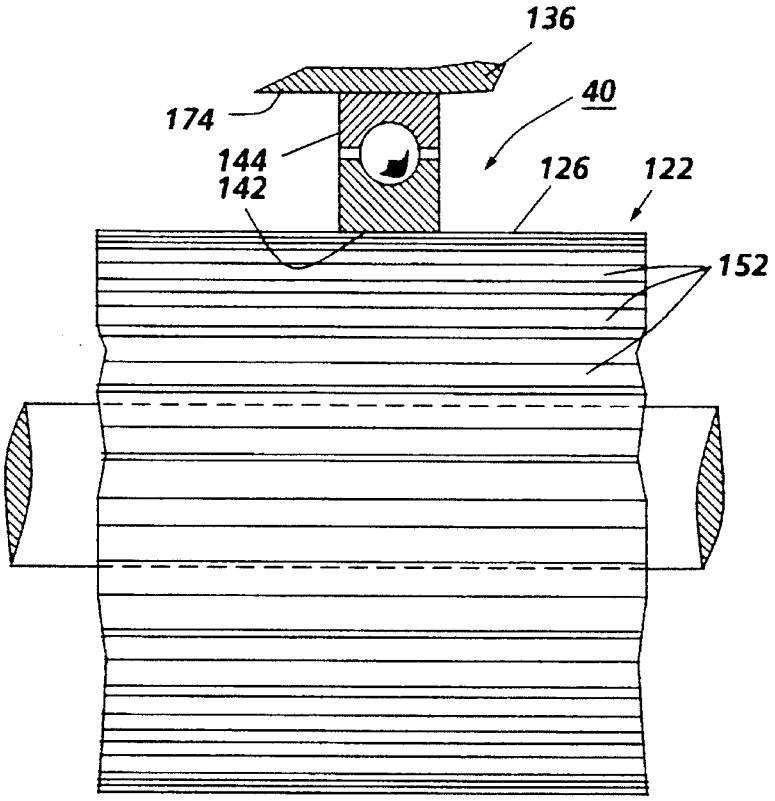
FIG. 4A is a partial plan view of the support portion of the body of the donor member of the external commutation segmented donor roll of FIG. 1.
Figure 4B:
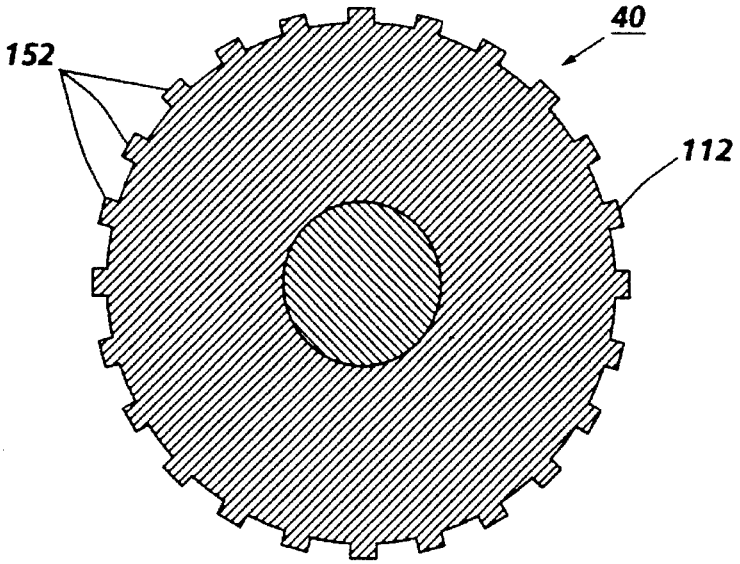
FIG. 4B is an end view of the support portion of FIG. 5A.

Referring now to FIG. 4A and 4B, a possible position of the electrical conductors 152 about the support portion 126 of the body 122 of the donor roll 40 is shown. The active electrodes 112 on the periphery of the support portion 126 are adjacent to the inner race 142 of the bearing 140. The periphery 174 of the backer bar 136 contacts outer race 144 of the bearing 140 and serves to position the backer bar 136 from the donor roll 40.

Figure 5:
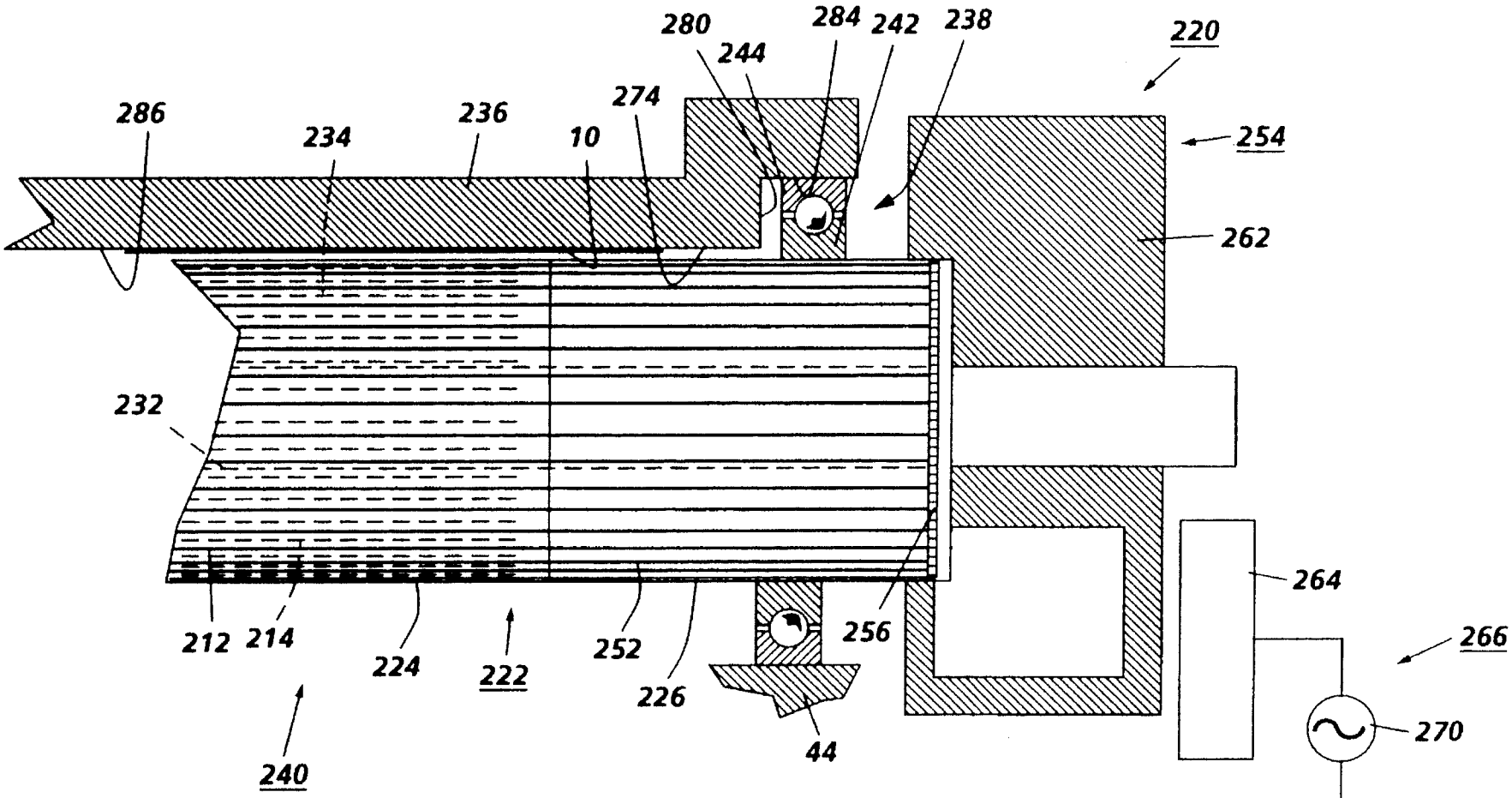
FIG. 5 is a schematic elevational view of a second embodiment of an external commutation segmented donor roll of the present invention.

Referring now to FIG. 5, an alternate embodiment of the external commutation system of the present invention is shown in external commutation system 220. Commutator system 220 is similar to the external commutation system 120 of FIG. 1 except that donor member 240 unlike donor member 40 of FIG. 1 has a periphery of uniform diameter and does not have the neck down region 130 of FIG. 1. The donor member 240 includes a rotatably mounted body 222 including a particle transportation portion 224 and a support portion 226. Bearing 238 is similar to bearing 140 of FIG. 1 and bearing 238 is mounted to housing 44. Bearing 238 supports the donor member 240 at inner race 242 of the bearing 238. Active electrode members 212 and common electrode members 214 are similar to active and common electrode members 212 and 214, respectively of FIG. 1. The members 212 and 214 are preferably located axially along the periphery of the rotatably mounted body 222 of the donor member 240 in the particle transportation portion 224 thereof. Electrical conductors 252 similar to electrical conductors 152 of FIG. 1 interconnect the active electrode members 212 to electrical connector 256. The electrical connector 256 is connected to commutator 254 which is similar to commutator 154 of FIG. 1. Backer bar 236, unlike backer bar 136 of FIG. 1, has a periphery 274 which includes step 280 in order that the backer bar 236 may rest upon outer race 244 of the bearing 240. The commutator system 220 of FIG. 5 provides for a more simple donor roll 240 while requiring a more complex backer bar 236.

Figure 6A:
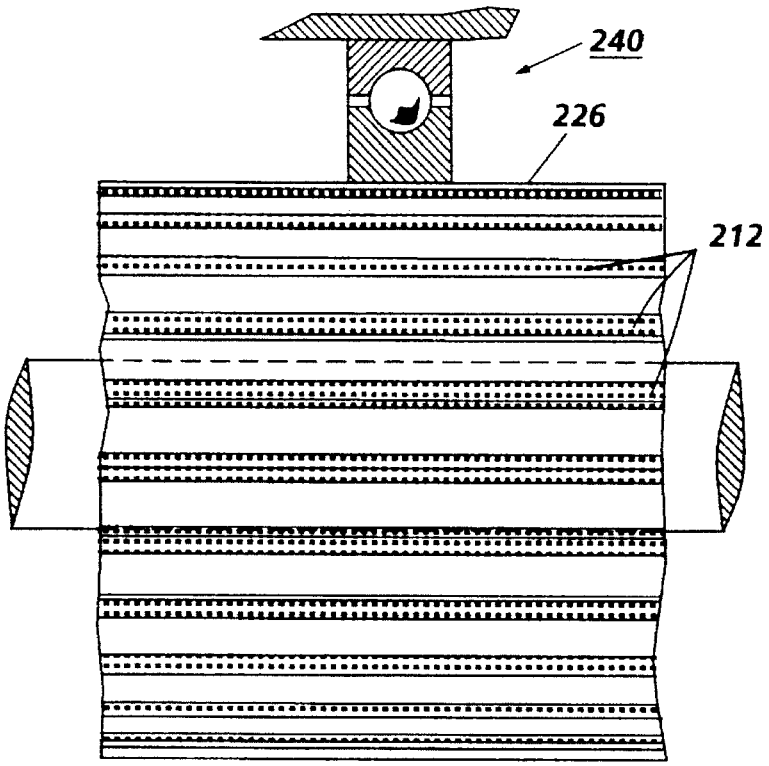
FIG. 6A is a partial plan view of the support portion of the body of the donor member of the external commutation segmented donor roll of FIG. 5.
Figure 6B:
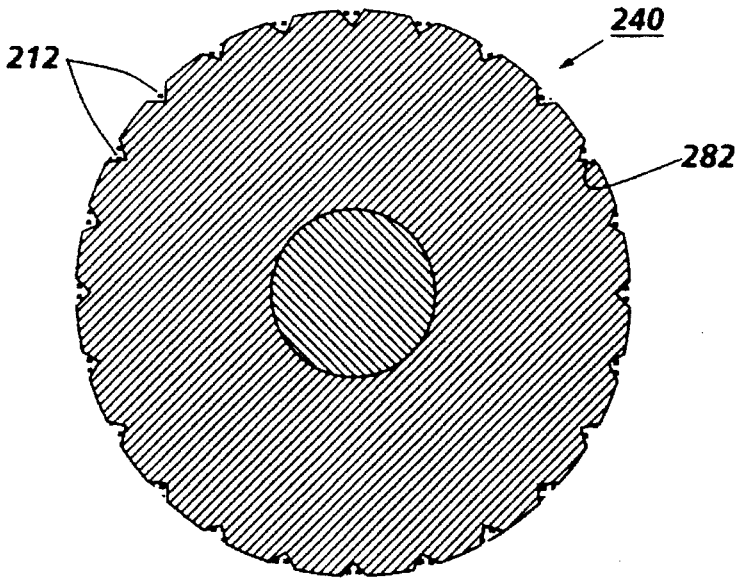
FIG. 6B is an end view of the support portion of FIG. 6A.

Referring now to FIGS. 6A and 6B, the support portion 226 of the donor roll 240 is shown in greater detail. The active electrode members 212 as shown in FIGS. 6A and 6B are positioned in grooves 282 along the periphery of the donor roll 240. It should be appreciated that the active electrode members 212 may alternatively be provided as a coated layer upon the periphery of the donor roll 240 as in FIG. 1.

Referring again to FIG. 5, the backer bar 236 includes a first periphery portion 284 which contacts outer race 244 of the bearing 240 as well as a second periphery portion 286 which serves to guide photoreceptor 10 near the periphery of the particle transportation portion 224 of the donor roll 240.

Figure 7A:
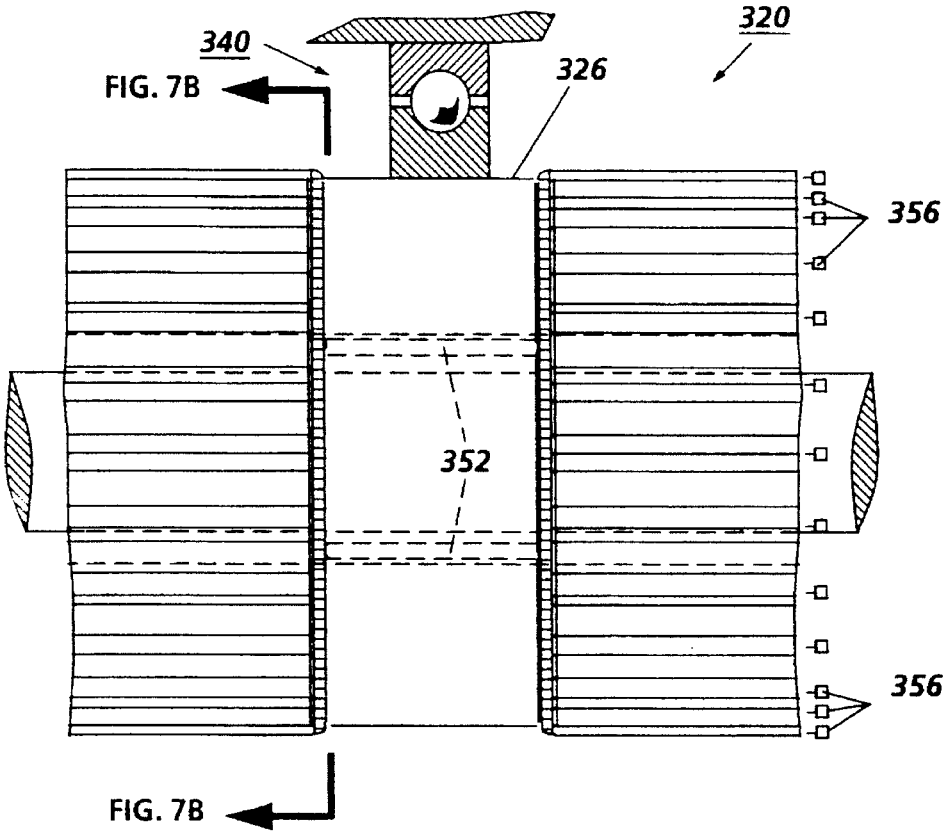
FIG. 7A is a partial plan view of the support portion of the body of the donor member of a third embodiment of an external commutation segmented donor roll of the present invention.
Figure 7B:
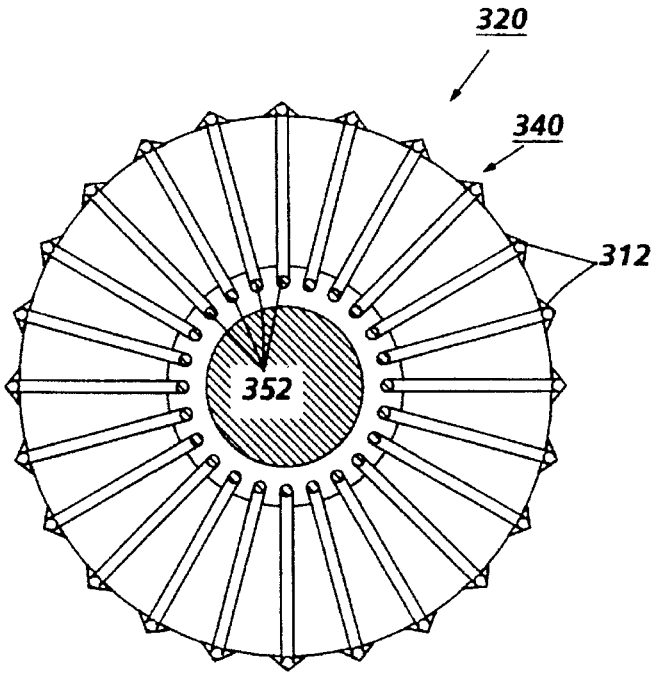
FIG. 7B is an end view of the support portion of FIG. 7A.

Referring now to FIGS. 7A and 7B, support portion 322 of a third embodiment of the external commutation system of the present invention is shown in external commutation system 320. External commutation system 320 is similar to external commutation systems 120 and 220 of FIGS. 1 and 5, respectively. Donor roll 340 is similar to donor member 240 of FIG. 5 except that electrical conductor 352 unlike electrical conductors 152 and 252 of FIGS. 1 and 5, respectively, are located internal to the periphery of the donor roll 340. The electrical conductor 352 may have any suitable shape and configuration and may be made of any suitable electrical conductor, for example, copper. The electrical conductor 352, for example, may be a flexible electrical wire which is electrically connected to active electrode members 312 and to electrical connectors 356.

By providing an electroded donor roll with external commutation, the length of the donor roll between the bearings may be minimized, thereby improving the strength and rigidity of the donor roll and minimizing the tolerance and ease of maintaining the quality requirements of the donor roll.

By providing a commutated donor member with external commutation, the diameter of the donor roll outside the bearings can be modified to optimize the commutation. The donor member outside the commutation area may be made smaller to save space or be made larger to provide an easier and more robust commutation. Also, commutation outside the bearings does not affect the size of the developer housing or components within the developer housing.

By providing commutation outside the bearings, the commutation may be provided outside the developer housing and the housing size and cost may be minimized.

By providing an electroded donor roll with external commutation and with a removable connection between the donor roll and the commutator a commutator module may be utilized. The commutator module can be changed without opening the developer housing.

By providing an electroded donor roll with external modular commutation, the commutator module can be changed without removing the donor roll from the machine.

By providing an electroded donor roll with external modular commutation, the commutator can be replaced from the machine with the original donor roll remaining in the machine.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A donor roll for transporting marking particles to an electrostatic latent image recorded on a surface, said donor roll adaptable for use with a power source to assist in transporting the marking particles, said donor roll comprising:

a rotatably mounted body including a particle transportation portion, a support portion adjacent the particle transportation portion, and an external portion adjacent the support portion and spaced from the particle transportation portion, said body defining an axis of rotation thereof;

an electrode member mounted on the particle transportation portion of said body; and an electrical conductor associated with the external portion of said body and extending in a direction at least partially parallel to the axis of rotation of said body, said electrical conductor electrically connected to said electrode member and adapted to be electrically connectable to the power source.

2. A donor roll according to claim 1, further comprising a commutator electrically connected to said electrical conductor.

3. A donor roll according to claim 2, wherein said commutator is removably connected to said body.

4. A donor roll according to claim 1, wherein a portion of said electrical conductor is at least partially interior to a periphery of the support portion of said body.

5. A donor roll according to claim 1, wherein a portion of said electrical conductor is attached to a periphery of the support portion of said body.

6. A donor roll according to claim 5, wherein:

said body defines a groove in the periphery of the support portion of said body; and wherein a portion of said electrical conductor is located in said groove.

7. A donor roll according to claim 1, wherein said electrical conductor extends in a direction substantially parallel to the axis of rotation of said body.

8. A donor roll according to claim 1, wherein said electrical conductor is so positioned with respect to the power source such that said electrical conductor is alternatively electrically connected and electrically disconnected from the power source with each revolution of the donor roll.

9. A developer unit for developing a latent image recorded on a surface of an image receiving member to form a developed image, said developer unit adaptable for use with a power source to assist in transporting the marking particles from the developer unit to said image receiving member, said developer unit comprising:

a housing defining a chamber for storing at least a supply of toner therein;

a bearing mounted to said housing;

a movably mounted donor member spaced from the surface and adapted to transport toner from the chamber of said housing to a development zone adjacent the surface, said donor member including a rotatably mounted body including a particle transportation portion, a support portion adjacent the particle transportation portion, and an external portion adjacent the support portion and spaced from the particle transportation portion, said body defining an axis of rotation thereof, an electrode member mounted on said body, and an electrical conductor associated with the external portion of said body and extending in a direction at least partially parallel to the axis of rotation of said body, said electrical conductor electrically connected to said electrode member, said support portion of said donor member mounted to said bearing; and a commutator electrically connected to said electrical conductor and adapted to be electrically connectable to the power source.

10. A developer unit according to claim 9, wherein said commutator is removably connected to said electrical connector.

11. A developer unit according to claim 9, wherein a portion of said electrical conductor is at least partially interior to a periphery of the support portion of said body.

12. A developer unit according to claim 9, wherein a portion of said electrical conductor is attached to a periphery of the support portion of said body.

13. A developer unit according to claim 9, wherein a periphery of the support portion of said donor roll is smaller than a periphery of the particle transportation portion of said donor roll.

14. A developer unit according to claim 9, wherein a portion of said bearing comprises an electrically insulative material.

15. A developer unit according to claim 9, wherein a portion of said donor member comprises an electrically insulative material.

16. A developer unit according to claim 9, wherein said electrical conductor extends in a direction substantially parallel to the axis of rotation of said body.

17. A developer unit according to claim 9, wherein said electrical conductor is so positioned with respect to the power source such that said electrical conductor is alternatively electrically connected and electrically disconnected from the power source with each revolution of the donor roll.

18. An electrophotographic printing machine of the type having a developer unit adapted to develop with marking particles an electrostatic latent image recorded on an image receiving member, said developer unit adaptable for use with a power source to assist in transporting the marking particles from the developer unit to said image receiving member, wherein the improvement comprises:

a housing defining a chamber for storing at least a supply of toner therein;

a bearing mounted to said housing;

a movably mounted donor member spaced from the surface and adapted to transport toner from the chamber of said housing to a development zone adjacent the surface, said donor member including a rotatably mounted body including a particle transportation portion, a support portion adjacent the particle transportation portion, and an external portion adjacent the support portion and spaced from the particle transportation portion, said body defining an axis of rotation thereof, an electrode member mounted on said body, and an electrical conductor associated with the external portion of said body and extending in a direction at least partially parallel to the axis of rotation of said body, said electrical conductor electrically connected to said electrode member, said support portion of said donor member mounted to said bearing; and a commutator electrically connected to said electrical conductor and adapted to be electrically connectable to the power source.

19. A printing machine according to claim 18, wherein said commutator is removably connected to said electrical connector.

20. A printing machine according to claim 18, wherein a portion of said electrical conductor is at least partially interior to a periphery of the support portion of said body.

21. A printing machine according to claim 18, wherein a portion of said electrical conductor is attached to a periphery of the support portion of said body.

22. A printing machine according to claim 18, wherein a periphery of the support portion of said donor roll is smaller than a periphery of the particle transportation portion of said donor roll.

23. A printing machine according to claim 18, wherein a portion of said bearing comprises an electrically insulative material.

24. A printing machine according to claim 18, wherein a portion of said donor member comprises an electrically insulative material.

25. A printing machine according to claim 18, wherein said electrical conductor extends in a direction substantially parallel to the axis of rotation of said body.

26. A printing machine according to claim 18, wherein said electrical conductor is so positioned with respect to the power source such that said electrical conductor is alternatively electrically connected and electrically disconnected from the power source with each revolution of the donor roll.

* * * * *